United States Patent [19]

DeMeester et al.

[11] 4,377,456

[45] Mar. 22, 1983

[54] PROCESS AND APPARATUS FOR TREATING PHOTOGRAPHIC FIXING BATHS

[75] Inventors: Philippe A. DeMeester, Rixensart; Jean-Pierre J. Heraly; Pierre F. Vandenput, both of Lasne, all of Belgium

[73] Assignee: Estorol A.G., Basel, Switzerland

[21] Appl. No.: 237,413

[22] Filed: Feb. 23, 1981

[30] Foreign Application Priority Data

Feb. 21, 1980 [LU] Luxembourg ..... 82188

[51] Int. Cl.[3] ..... C25B 15/02; C25C 1/22

[52] U.S. Cl. ..... 204/109; 204/231

[58] Field of Search ..... 204/109, 231

[56] References Cited

U.S. PATENT DOCUMENTS 4,186,067 1/1980 Blake et al. ..... 204/109

4,287,044 9/1981 Biles et al. ..... 204/109

*Primary Examiner*—Howard S. Williams

*Attorney, Agent, or Firm*—Fred A. Keire

[57] ABSTRACT

The process for treating a photographic fixing bath, in order to remove therefrom the silver in metallic form by electrolysis in an electrolysis cell comprising at least one cathode on which the silver is deposited, two anodes and a control electrode placed in the vicinity of the cathode, comprises the step of adjusting the intensity of the electrolysis current by measuring the potential difference between a cathode serving as a working electrode and the control electrode.

The apparatus for treating a photographic fixing bath in order to remove therefrom the silver comprises an electrolytic cell containing, as electrodes, at least one cathode and anodes as well as a control electrode made of pure carbon immersed in a stirred electrolytic bath, the voltage of this control electrode being maintained at a constant reference value and the potential on this control electrode serving to control the electrolysis current in operation.

10 Claims, 2 Drawing Figures

PROCESS AND APPARATUS FOR TREATING PHOTOGRAPHIC FIXING BATHS

BACKGROUND OF THE INVENTION

This invention relates to a process and an apparatus for treating photographic fixing baths, in order to remove therefrom the silver as metallic silver by electrolysis in a bath containing electrodes, i.e. at least one cathode and anodes.

Processes and apparatuses in which a fixing bath is submitted to an electrolysis so as to recover the silver in metallic form on at least one cathode are known. In these known processes and apparatuses, the electric current of electrolysis must have a sufficiently low intensity for avoiding a sulphurization of the silver. Due to the fact that the electrolysis current must be small, the recovery of the silver is far from being complete and sometimes more than 2 grams per liter of silver are lost in the drained electrolyzed fixing baths. This represents an uneconomical and of course, a substantial loss of silver.

Moreover, the statutes of the industrialized countries prohibit the drainage of photographic fixing baths containing silver salts. Although the laws vary from one country to another, it can be said that the maximum amount of silver which may be contained in the photographic fixing baths is of about 0.1 mg of silver per liter of sewage water. Practically, only baths substantially free from silver may be drained; the silver content of said baths must be measured at the outlet of the photographic development apparatus.

In a known process for treating a photographic fixing bath in order to remove therefrom the silver as a metal, the photographic fixing bath containing an excess of an anti-oxidizing agent is submitted to an electrolysis, so as to cause the deposit of metal silver onto at least one cathode placed between two anodes in the stirred electrolytic bath, the pH being maintained at about 3.5–4.5 and the electrolysis current being regulated or controlled in said bath according to its silver content, the intensity of the current being caused to decrease as the silver content of the bath diminishes. The electrolyzed bath may be used again as photographic fixing bath.

The potential difference to be applied to the electrodes during the electrolysis must comprise at least the potential difference necessary to overcome the ohmic resistance of the electrolytic cell, the concentration polarization due to the gradients of concentration in the electrolyte and the over-voltage inherent in the speed of the reactions occuring at the electrodes.

When a significant potential difference is applied to the electrodes during the electrolysis, secondary reactions occur on the electrodes, said secondary reactions being harmful to the purity and the quality of the silver deposited onto the cathode. an undesirable precipitate of silver sulfide may possibly be formed in the photographic fixing bath. The electrolysis rate is affected by the electrolytic current and consequently by the potential difference applied to the electrodes.

In order to perform the electrolysis rather quickly, avoiding secondary reactions in the photographic fixing bath at low silver concentrations, the electrolysis current is modified during said electrolysis.

Apparatus for treating photographic fixing baths are known, wherein the electric current of the electrolysis is regulated during operation, either depending on the silver concentration of the photographic fixing bath or on the resistivity of the electrolytic cell, or even depending on the overvoltage on the cathode.

These known apparatuses have the following disadvantages.

The known apparatuses measuring the concentration of silver ion are expensive and complicated.

The known apparatuses, based on the measure of the resistivity variation of the bath during the electrolysis only give a relative measure of the exhaustion of the bath. The resistivity of the electrolytic cell varies with the composition of the bath. It is therefore necessary to adjust the apparatus before each treatment as a function of the exact amount of anti-oxidant and other products added to the photographic fixing bath. Moreover, it is manadatory to keep the bath at a constant temperature, so that it is necessary to use a thermostat.

The known apparatus, based on the measure of the overvoltage at the cathode by means of a reference electrode connected by a silver nitrate bridge located about the cathode, allow the electrolysis to be controlled up to very low silver contents. However, this system implies the need of using a number of liquid junctions of various electrolytes, such as silver nitrate and for example mercury chloride, when a calomel reference electrode is used. The migration of different ions causes, during the electrolysis, irreversible phenomena which modify the over-voltage value at the electrolyte junctions.

SUMMARY OF THE INVENTION

The object of the invention is to provide a process and an apparatus for treating a photographic fixing bath in order to remove therefrom the silver as metallic silver, which do not have the disadvantages of the known processes and apparatus.

In the process according to this invention, the electrolytic current intensity is controlled by measuring the potential difference between a control electrode immersed in the electrolytic bath and a cathode used as a working electrode.

According to a feature of the invention, the electrolytic current is advantageously controlled as a function of the potential difference between a control electrode made of pure carbon and immersed in the electrolytic bath and a cathode used as a working electrode, while the potential of the control electrode is maintained at a constant reference value.

The apparatus for treating a photographic fixing bath according to the invention comprises a control electrode made of pure carbon and immersed in the electrolytic bath in the space between one of the anodes and a cathode used as a working electrode and placed adjacent the latter, and a regulating device connected to the control electrode and said cathode and arranged for controlling the electrolytic current in response to the potential difference between said control electrode and said cathode.

The process and the apparatus according to the invention have the following advantages:

1. the potential difference between the control electrode and the working cathode is a precise and continuous measurement of both the resistivity of the electrolytic bath, which is usually rather low, and the overvoltage at the working cathode, this being not the case in the processes which sometimes use two control electrodes;

2. due to liquid electrolyte junctions being avoided, it is not necessary to adjust the apparatus before each treatment of a photographic fixing bath, as a function of irreversible phenomena which modify the value of the overvoltage at said junctions;

3. the apparatus does not need any adjustment, even if the composition of the photographic fixing baths to be treated varies;

4. the apparatus does not need maintaining a constant temperature during the electrolysis.

DESCRIPTION OF THE DRAWINGS

Other features and details of the invention will appear from the following detailed description, wherein reference is made to the attached schematic drawings, in which.

In these figures, the same references denote identical elements.

DESCRIPTION OF AN EXEMPLARY EMBODIMENT

The purpose of the process and the apparatus according to the invention is to recover the silver contained in a photographic fixing bath during the progressive silver saturation of said bath, in order to extend the life of this fixing bath.

Figure 1:
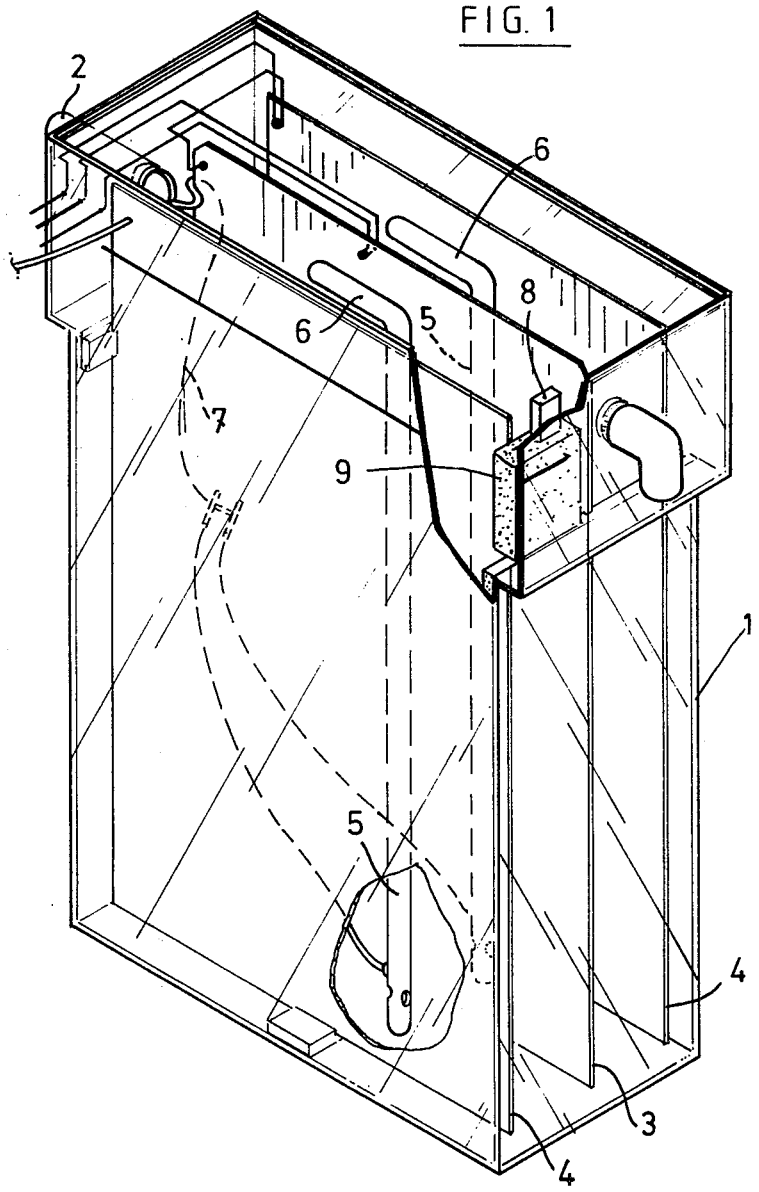
FIG. 1 is a partially broken perspective view of an electrolytic cell used in the apparatus of the invention.

The apparatus for treating a photographic fixing bath according to the invention, shown in FIG. 1, comprises, as it is known, an electrolytic cell 1 provided downstream of a vessel (not shown) wherein the fixing of a photographic film is realized and of which the overflow is sent through a pipe 2 into the electrolytic cell 1.

As shown in FIG. 1, the electrolytic cell 1 according to the invention, contains at least one cathode 3, in the form of a plate, for instance of stainless steel, located between two anodes 4 comprised for instance of graphite plates of high density and high purity. The cathode 3 and the anodes 4 are maintained in the proper position and guided in the electrolytic cell 1 by known means (not shown).

In the spaces between the cathode 3 and the anodes 4 there is a stirrer which consists of an immersed pipe 5, the upper end of which is curved as shown at 6. To this pipe, the lower end of which is perforated to allow the introduction of electrolyte in the pipe, is connected a pipe 7 for feeding said tube 5 with compressed air from a compressed air source (not shown). The compressed air brought to the lower part of the immersed pipe 5 is ejected from the free end 6 thereof as a mixture with liquid fixing solution, thereby creating a permanent stirring or turbulence in the spaces between the cathode 3 and the anodes 4, so that the silver ions which are present in the electrolytic bath are brought in the vicinity of the cathode or cathodes 3 for being fixed thereon. Between one of the anodes 4 and the cathode 3 in the electrolytic cell, there is provided a control electrode 8 which is immersed in the electrolytic bath. This electrode, which has a defined electric potential relative to the cathode 3, has a function in operation which will be explained later herein.

The cathode 3, the anodes 4 and the control electrode 8 are connected by electrical conductors to a control device provided in a box (not shown) which also contains the compressed air feeding device.

The photographic fixing bath used in the process according to the invention is preferably an aqueous solution containing about 100 to 200 g/l ammonium thiosulfate or sodium thiosulfate and 0 to 50 g/l ammonium thiocyanate, as well as an excess of sodium sulfite, the concentration of which may reach 60 g/l. This bath also contains a known tanning agent at an initial concentration that may range to about 15 g/l, said concentration being usually comprised between about 5 and 15 g/l. The pH of the photographic fixing bath is maintained at a value of about 3.5 to 4.5 by adding, in case of need, a small amount of an acid, such as acetic acid.

It is obvious that instead of a single cathode 3 and two anodes 4, the electrolytic cell 1 may contain any greater number of cathodes and anodes, the number of anodes being always higher by 1 to the number of cathodes.

Figure 2:
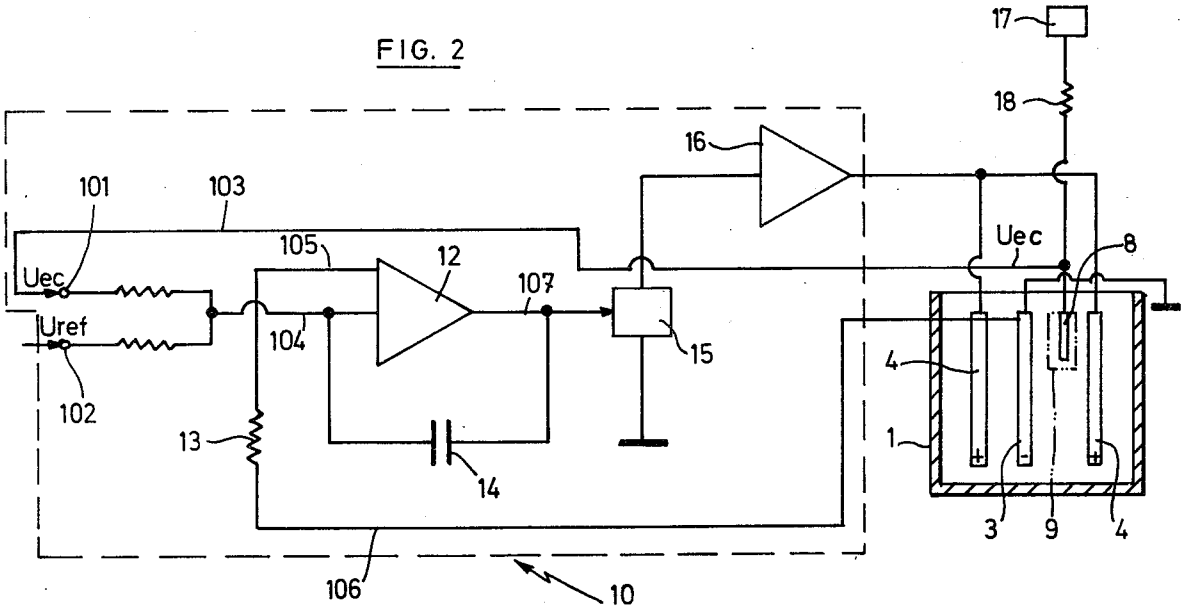
FIG. 2 is a schematic drawing of the current regulating device in accordance with the invention.

As mentioned earlier herein, the electrolytic current in cell 1 is regulated based on the silver concentration of the electrolytic bath so that the current is caused to decrease as the silver concentration decreases as low as a predetermined low value, e.g. 0.5–2 g/l. This regulation is carried out based on the electric potential of the control electrode 8 through the operation of a regulating device 10 a circuit diagram of which is illustrated in FIG. 2. This device is arranged to maintain the potential $U_{ec}$ on the control electrode 8 at a predetermined reference value and to compare said potential with the potential on cathode 3 in order to control the electrolytic current. For that purpose the potential $U_{ec}$ on the control electrode 8 is applied through line 103 to the input terminal 101 of the regulating device 10. A second input terminal 102 of this device accepts the predetermined reference potential $U_{ref}$. The potentials $U_{ec}$ and $U_{ref}$ have opposite polarities and are added in the resistor arrangement 11: the sum of these potentials is applied to a first input 104 of an operational amplifier 12, a second input 105 of which accepts the cathode potential $U_c$ through line 106 and resistor 13. An integrating capacitor 14 is connected in parallel with the amplifier 12.

When potential $U_{ec}$ is equal to potential $U_{ref}$ in absolute value (these potentials have opposite polarities), no current flows through line 104 and the voltage across the capacitor 14 is at a constant value. The voltage on line 107 connected to the output of amplifier 12 controls a current generator 15. The generated current, after being amplified in amplifier 16, supplies the anodes 4 for producing the electrolytic current in the cell 1.

When the absolute value of potential $U_{ec}$ becomes lower than potential $U_{ref}$, there appears on line 104 a current which charges the capacitor 14 whereby the voltage on line 107 varies; this voltage variation causes the generated current from generator 15 to vary and thereby the electrolytic current to be reduced. This current variation is effective to restore the potential on the control electrode 8 and the potential difference between said electrode and cathode 3.

The rule which governs the value of the potential difference between the control electrode 8 and the cathode or cathodes 3 coated with silver, is expressed by the following relation:

$$U_{ec} = U_{eco} - 59\ mV\ \mathrm{Log}\ \frac{[Ag]}{[Ag]_{to}}$$

in which:

$U_{ec}$ is the control electrode potential, $U_{eco}$ is the control electrode potential at time zero,

[Ag] is the silver concentration of the bath at the considered time, $[Ag]_{to}$ is the silver concentration of the bath at time zero.

Advantageously, the reference potential $U_{ref}$ is chosen equal to the potential value that would have the control electrode 8 at a silver concentration of the bath of about 0.5 to 2 g/l and an electrolytic current having an intensity of zero. The reference potential $U_{ref}$ is for instance 300 to 600 millivolts.

The control electrode 8 is advantageously polarized by a small current, e.g. of 1 m A, to protect this electrode from any surface alteration thereof. This advantageous arrangement is illustrated in FIG. 2 which shows the electrode 8 connected to a voltage generator 17 through a resistor 18.

The control electrode 8 is protected by a sheath 9, made for instance of foam, in order to avoid turbulence in the immediate vicinity of this electrode for such a turbulence may induce undesirable variation in the electric potential of this control electrode.

It is to be understood that the present invention is nowise limited to the particular exemplary embodiment described in the foregoing and a number of variations may be made by those skilled in the art without departing from the scope of this invention.

What is claimed is:

1. A process for treating a photographic fixing bath in order to remove therefrom silver in a metallic form, comprising stirring a photographic fixing bath, electrolyzing said bath so as to cause metallic silver to be deposited onto at least one cathode placed between anodes, regulating the current intensity in said bath by a control electrode of pure carbon placed near the cathode, in which the electrolysis current intensity is regulated due to variations encountered such as due to the silver concentration and temperature, said regulating being effected by measuring a potential difference between a cathode used as working electrode and the control electrode and by appropriately adjusting said electrolysis current intensity, as needed, in response to said measured potential difference.

2. A process according to claim 1, in which the electrolysis current intensity is controlled in dependence on the potential difference between the control electrode made of pure carbon and immersed in the electrolytic bath, and a cathode used as a working electrode, the potential of the working electrode being maintained at a constant reference value.

3. A process according to claim 1, in which the potential on the control electrode is maintained at a value equal to that which it would have if the silver content of the electrolysis bath would have decreased to a value between about 0.5 and 2 g/l, when the electrolysis current has an intensity of zero.

4. A process according to claim 3, in which the potential on the control electrode is maintained at a reference value of about 300 to 600 millivolts.

5. A process according to claim 1, in which a quiescent electrolyte zone is maintained in the vicinity of the control electrode.

6. An apparatus for treating a photographic fixing bath in order to remove therefrom the silver in metallic form, containing a stirred electrolyte bath, at least one cathode used as a working electrode, several anodes and a control electrode of pure carbon immersed in said electrolyte bath, and a regulating device connected to said control electrode and said cathode, the regulating device being arranged to regulate the electrolyte current through the electrolyte bath in response to the potential difference between the control electrode and said cathode.

7. An apparatus according to claim 6, wherein the regulating device is arranged to maintain the potential on the control electrode at a substantially constant value relative to the potential on said cathode.

8. An apparatus according to any one of claims 6 or 7, wherein the regulating device comprises adder means connected to add the potential on the control electrode and a reference potential; comparator/integrator means having an input connected to the output of the adder means and a second input connected to accept the potential on said cathode and arranged to integrate the potential difference between the control electrode and said reference potential and to compare the integrated potential value with the cathode potential in order to produce a control signal, and a current generator connected to be responsive to said control signal for generating the electrolytic current.

9. An apparatus according to claim 8, comprising a device for polarizing the control electrode.

10. An apparatus according to claim 8, wherein the control electrode is provided with protective means for inhibiting the stirring of the electrolytic bath in the vicinity of the control electrode.

* * * * *